US006499326B1

(12) United States Patent
Heussner

(10) Patent No.: US 6,499,326 B1
(45) Date of Patent: Dec. 31, 2002

(54) ELECTRONIC FLAT KEY

(75) Inventor: Uwe Heussner, Remscheid (DE)

(73) Assignee: Valeo GmbH & Co. Schliesssysteme KG, Neuss (DE)

( * ) Notice: Subject to any disclaimer, the term of this patent is extended or adjusted under 35 U.S.C. 154(b) by 13 days.

(21) Appl. No.: 09/697,360

(22) Filed: Oct. 27, 2000

(30) Foreign Application Priority Data

Oct. 29, 1999 (DE) ..... 199 52 247

(51) Int. Cl.[7] ..... E05B 19/08; E05B 19/12

(52) U.S. Cl. ..... 70/399; 70/408; 70/396

(58) Field of Search ..... 70/408, 413, 399, 70/396, 456 R

(56) References Cited

U.S. PATENT DOCUMENTS

| | | | | | |
|---|---|---|---|---|---|
| 4,524,594 | A | * | 6/1985 | Bascou | 70/456 R |
| 4,888,970 | A | * | 12/1989 | Kinzler et al. | 70/456 R |
| 4,941,569 | A | * | 7/1990 | Lindmayer et al. | 206/38.1 |
| 5,819,568 | A | * | 10/1998 | Christie et al. | 70/395 |
| 5,832,761 | A | * | 11/1998 | Chen | 70/395 |
| 6,164,101 | A | * | 12/2000 | Kito et al. | 70/278.3 |
| 6,276,179 | B1 | * | 8/2001 | Janssen et al. | 70/278.3 |
| 6,367,298 | B1 | * | 4/2002 | Janssen et al. | 70/278.3 |
| 6,367,299 | B1 | * | 4/2002 | Janssen et al. | 70/278.3 |
| 6,427,504 | B1 | * | 8/2002 | Janssen et al. | 70/278.3 |

FOREIGN PATENT DOCUMENTS

| | | |
|---|---|---|
| DE | 3902537 | 11/1990 |

* cited by examiner

*Primary Examiner*—Anthony Knight
*Assistant Examiner*—John B. Walsh
(74) *Attorney, Agent, or Firm*—Liniak, Berenato & White

(57) ABSTRACT

The invention relates to an electronic flat key having a grip element (2) and a key bit (3), the grip element (2) including a casing (4) in which are arranged an electronic switching device (12) for remote operation of a lock or locking system and a holder (16) for at least one battery (17) for supplying power to the switching device, the grip element casing (4) including two side elements (5, 6) constructed in the form of shells, and the key bit (3) being arranged on the grip element casing (4) in a manner enabling it to be swiveled from a retracted position, in which it is situated in a lateral well (10) in the grip element casing (4), into an extended position. In order for the grip element casing (4) to also consist of metallic side elements (5, 6) constructed in the form of shells, without this substantially affecting (electrically shadowing) the transmitting and/or receiving elements located in the casing (4) for remote operation or a lock or locking system, the invention proposes that between the two side elements (5,6) of the grip element casing (4), which are made of metal and are constructed in the form of shells, there is arranged a central element (7) of frame-like construction which is made of a material that does not conduct electricity, which extends peripherally at least in sub-portion (8) of the grip element casing (4) as far as the outer surface (9) of the casing (4) and is sufficient for conveying an adequate signal between the transmitting and/or receiving elements located in the grip element casing (4) and those located in the lock zone or locking system zone.

8 Claims, 1 Drawing Sheet

ELECTRONIC FLAT KEY

BACKGROUND OF THE INVENTION

The invention relates to an electronic flat key in accordance with the features of the preamble of Claim 1.

DESCRIPTION OF THE PRIOR ART

Flat keys of this type are for example known from DE 39 02 537 C2. They are essentially composed of a grip element and a key bit, the grip element including a casing and the key bit being arranged on the casing of the grip element in a manner enabling it to be swiveled from a retracted position, in which it is located in a lateral well in the grip element casing, into an extended position. In the case of the conventional flat key the grip element casing consists of two shell-type plastics side elements joined together, which enclose an electronic switching device for remote operation of a lock or locking system. In addition, there is disposed in the grip element casing a holder which houses the batteries for supplying power to the electronic switching device. The holder is contiguous with the surface of one of the two shell-type side elements and is sealed towards the exterior by a sliding cover.

The drawbacks of these known flat keys include the fact that the side elements cannot be made of metal, for a corresponding grip element casing would mean that the transmitting or receiving elements located in the grip element casing would be electrically shadowed in an undesirable manner. However, for reasons concerned with stability and with adapting the design of the flat key to the respective vehicle, flat keys having a grip element casing made of metal are often desired.

The known keys also have the drawback that the battery compartment is relatively easily accessible and therefore time and again the sliding cover inadvertently becomes displaced and the batteries can then fall out of the battery compartment.

SUMMARY OF THE INVENTION

It is the underlying object of the invention to provide an electronic flat key on which the grip element casing consists of metal side elements constructed in the form of shells, without this essentially affecting (electrically shadowing) the transmitting and/or receiving elements located in the casing for remote operation of a lock or locking system.

In accordance with the invention this object is achieved by the features contained in Claim 1. The subsidiary claims disclose additional, particularly advantageous embodiments of the invention.

The invention is essentially based on the concept of arranging between the two metal shell-type side elements of the grip element casing a central element, in the form of a frame, made of a material that does not conduct electricity, which extends peripherally at least in sub-portions of the grip element casing as far as the outer surface of the casing and is sufficient to convey an adequate signal between the transmitting and/or receiving elements located in the grip element casing and those located in the lock zone or locking system zone.

The frame-type central element may for example be made of plastic or even rubber, and is preferably constructed in such a way that it also acts as a sealing element for sealing off the internal compartment of the grip element casing against external influences.

To prevent the battery cover from being removed unintentionally, another form of embodiment of the invention provides for the battery compartment holder situated in the grip element casing to be internally contiguous with the well for receiving the key bit, with the result that the batteries can only be inserted into the holder or removed therefrom when the key bit is in the extended position.

For rapid installation of the batteries it has proved advantageous if the batteries are placed in a separate battery compartment before being inserted into the battery compartment holder, and then the battery compartment, loaded with a plurality of batteries if appropriate, is pushed into the holder and joined to the latter via, for example, a clip-type connection.

To allow the assembly or disassembly of the flat key according to the invention to be undertaken in a straightforward manner, it has also proved expedient if at least one side element incorporates projections in predetermined peripheral zones, which projections protrude beyond the central element and by means of which said side element can be clipped onto the respective other side element.

BRIEF DESCRIPTION OF THE DRAWINGS

Further details and advantages of the invention will become clear on reading the detailed description below of a preferred embodiment, taken only as a non-limitative example, making reference to the attached drawings of which.

DETAILED DESCRIPTION OF A PREFERRED EMBODIMENT

Figure 1:
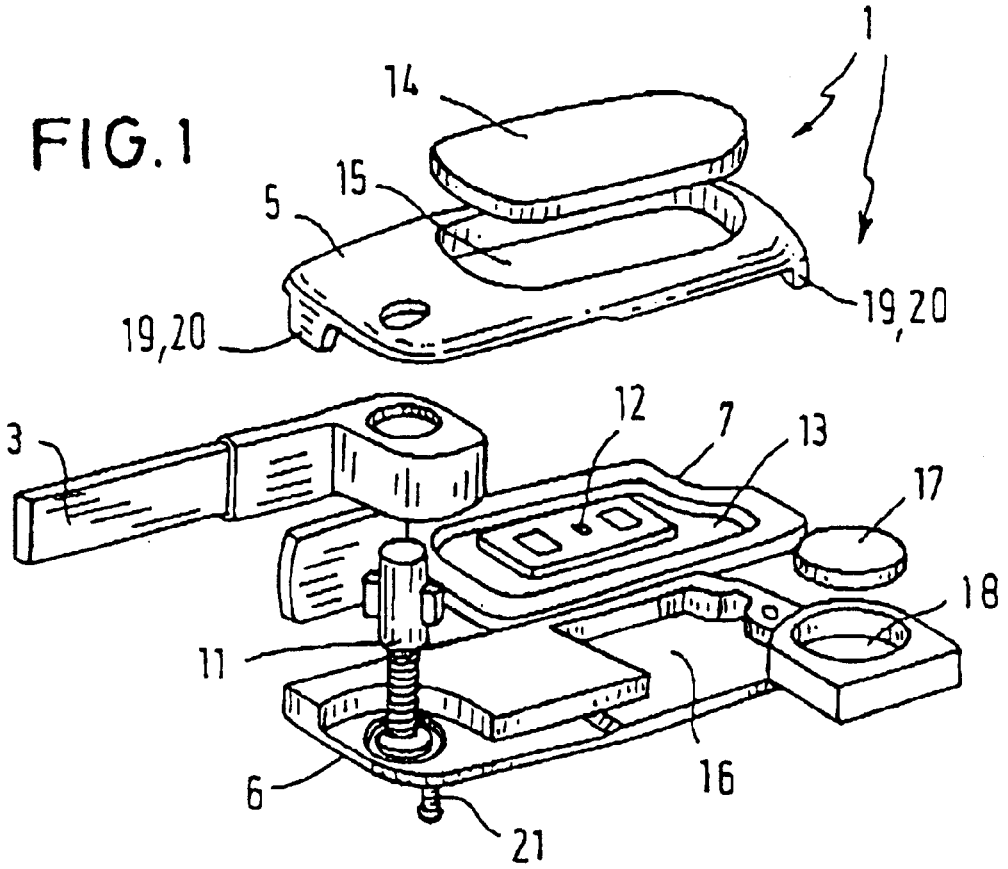
FIG. 1 shows an exploded view of a flat key in accordance with the invention, with the key bit extended.
Figure 2:
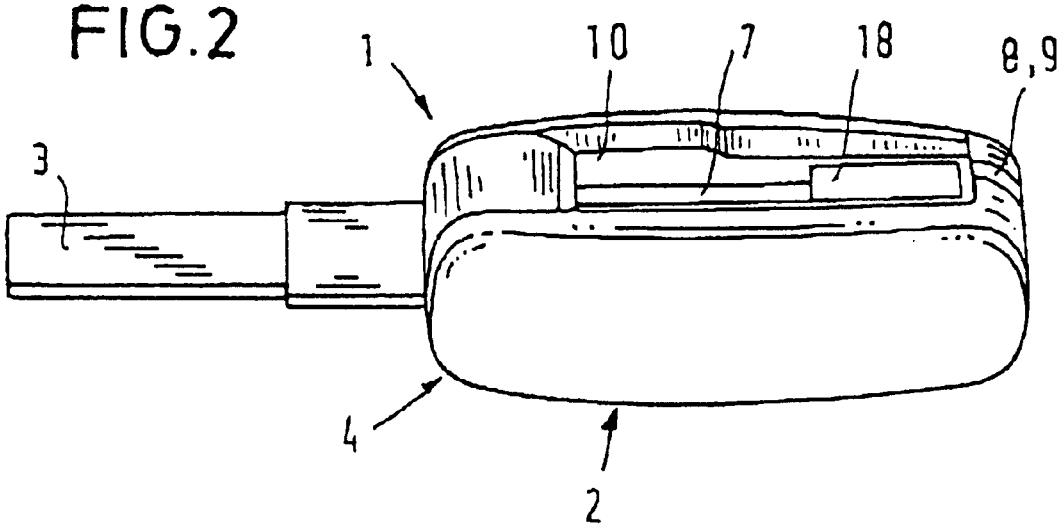
FIG. 2 is a perspective view of the flat key represented in FIG. 1, shown assembled.

In FIGS. 1 and 2, 1 designates an electronic flat key consisting essentially of a grip element 2 and a key bit 3. The grip element 2 includes a casing 4 with two shell-type side elements 5, 6 made of a light metal (e.g. aluminum) which are adapted to be clipped together. Between the side elements 5, 6 is a central element 7 made of plastic in the shape of a frame, which extends in sub-portions 8 of the grip element casing 4 as far as the outer surface 9 of the casing.

The key bit 3 is rotatably mounted in the grip element casing 4 and can be swiveled from a retracted position into an extended position. In the retracted position it is located in a lateral wall 10 in the grip element casing 4 and is held in this position by locking means. A rotary spring swivels the key bit 3 into its extended position by applying pressure to a spring-actuated push-button 11.

The grip element casing 4 encloses an electronic switching device 12 (e.g. a transponder) for remote operation of a vehicle lock (not shown). The electronic switching device 12 may be arranged on a printed circuit board which is essentially disposed inside a recess 13 in the central element 7. To activate the switching device 12, the latter is connected to a push-button 14 which is displaceably mounted in a recess 15 in the side element 5.

Also arranged in the grip element casing 4 is a battery compartment holder 16 which is internally contiguous with the well 10 for receiving the key bit 3 and is therefore only accessible when the key bit is in the extended position. Therefore only in this position is it possible to insert or remove a battery compartment 18 which contains the batteries 17 needed to operate the electronic switching device 12.

For connecting the two side elements 5, 6, side element 5 incorporates in peripheral zones 19 projections 20 which protrude past the central element 7 and by means of which said side element is clipped to side element 6.

It will be clear to professionals of the art that the invention is not restricted to the exemplifying embodiment outlined above. For example the side elements of the grip element casing may alternatively be joined by a screwed connection instead of by a clip-on connection. FIG. 1 shows a corresponding screw, identified by reference numeral 21.

It is also possible to use a different metal (steel, titanium, etc.) or an externally metalized plastic as the material for the shell-type side elements, instead of a light metal or light metal alloy.

What is claimed is:

1. An Electronic flat key having a grip element (2) and a key bit (3), the grip element (2) including a casing (4) in which there are arranged an electronic switching device (12) for remote operation of a lock or locking system and a holder (16) for at least one battery (17) for supplying power to the switching device, the grip element casing (4) including two side elements (5, 6) constructed in the form of shells, and the key bit (3) being arranged on the grip element casing (4) in a manner enabling it to be moved out of a retracted position, in which it is situated in the grip element casing (4), into an extended position, wherein the side elements (5, 6) of the grip element casing (4), which are constructed in the form of shells, are made of one a metal and an externally metalized plastic and that between the two side elements (5, 6) there is arranged a central element (7), constructed in the form of a frame and made from an electrically non-conductive material, which extends peripherally at least in sub-portions (8) of the grip element casing (4) as far as the outer surface (9) of the casing (4).

2. An electronic flat key having a grip element (2) and a key bit (3), the grip element (2) including a casing (4) in which there are arranged an electronic switching device (12) for remote operation of a lock or locking system and a holder (16) for at least one battery (17) for supplying power to the switching device, the grip element casing (4) including two side elements (5, 6) constructed in the form of shells, and the key bit (3) being arranged on the grip element casing (4) in a manner enabling it to be moved out of a retracted position, in which it is situated in the grip element casing (4), into an extended position, wherein the side elements (5, 6) of the grip element casing (4), which are constructed in the form of shells, are made of one of a metal and an externally metalized plastic and that between the two side elements (5, 6) there is arranged a central element (7), constructed in the form of a frame and made from an electrically non-conductive material, which extends peripherally at least in sub-portions (8) of the grip element casing (4) as far as the outer surface (9) of the casing (4), wherein said battery compartment holder (16) situated in said grip element casing (4) is internally contiguous with a well (10) for receiving said key bit (3), with the result that said battery (17) can only be inserted into said holder (16) or removed therefrom when said key bit (3) is in the extended position.

3. The electronic flat key according to claim 2, wherein said battery (17) is adapted to be arranged in a separate battery compartment (18) and said battery compartment (18) is adapted to be inserted into said battery compartment holder (16) and to be joined thereto.

4. The electronic flat key according to claim 3, wherein said battery compartment (18) and said battery compartment holder (16) are adapted to be joined to one another via a clip-on connection.

5. A electronic flat key having a grip element (2) and a key bit (3), the grip element (2) including a casing (4) in which there are arranged an electronic switching device (12) for remote operation of a lock or locking system and a holder (16) for at least one battery (17) for supplying power to the switching deice, the grip element casing (4) including two side elements (5, 6) constructed in the form of shells, and the key bit (3) being arranged on the grip element casing (4) in a manner enabling it to be swiveled out of a retracted position, in which it is situated in the grip element casing (4), into an extended position, wherein the side elements (5, 6) of the grip element casing (4), which are constructed in the form of shells, are made of one of a metal and an externally metalized plastic and that between the two side elements (5, 6) there is arranged a central element (7), constructed in the form of a frame and made from an electrically non-conductive material, which extends peripherally at least in sub-portions (8) of the grip element casing (4) as far as the outer surface (9) of the casing (4), wherein at least one side element (5) incorporates projections in predetermined peripheral zones, which projections protrude past the central element and by means of which said side element is adapted to be clipped onto the respective other side element.

6. The electronic flat key according to any of claim 1, wherein said grip element (2) is provided with a push-button (14) for actuating said electronic switching device (12) arrange din said grip element (2) and wherein one of said two side elements (5, 6) incorporated a recess (15) for feeding through the push-button (14).

7. The electronic flat key according to any of claim 1, wherein the central element (7) is made of plastic.

8. The electronic flat key according to any of claim 1, wherein said side elements (5, 6) are made of a light metal.

* * * * *